US008077109B1

(12) United States Patent
Roberts et al.

(10) Patent No.: US 8,077,109 B1
(45) Date of Patent: Dec. 13, 2011

(54) METHOD AND APPARATUS FOR WIDEBAND PLANAR ARRAYS IMPLEMENTED WITH A POLYOMINO SUBARRAY ARCHITECTURE

(75) Inventors: Thomas M. Roberts, Bedford, MA (US); Scott G. Santarelli, Dracut, MA (US); Robert J. Mailloux, Wayland, MA (US)

(73) Assignees: University of Massachusetts, Boston, MA (US); The United States of America as represented by the Secretary of the Air Force, Washington, DC (US)

( * ) Notice: Subject to any disclaimer, the term of this patent is extended or adjusted under 35 U.S.C. 154(b) by 488 days.

(21) Appl. No.: 12/228,202

(22) Filed: Aug. 11, 2008

Related U.S. Application Data

(60) Provisional application No. 60/964,145, filed on Aug. 9, 2007.

(51) Int. Cl.
*H01Q 21/08* (2006.01)
*H01Q 1/38* (2006.01)

(52) U.S. Cl. ..... 343/824; 343/700 MS; 716/110; 29/600

(58) Field of Classification Search ..... None
See application file for complete search history.

(56) References Cited

U.S. PATENT DOCUMENTS

| | | | | |
|---|---|---|---|---|
| 6,621,470 | B1 * | 9/2003 | Boeringer et al. | 343/853 |
| 7,057,559 | B2 * | 6/2006 | Werner et al. | 343/700 MS |
| 7,187,325 | B2 * | 3/2007 | Subotic et al. | 342/374 |
| 7,522,095 | B1 * | 4/2009 | Wasiewicz et al. | 342/160 |
| 2005/0259004 | A1 * | 11/2005 | Subotic et al. | 342/368 |

OTHER PUBLICATIONS

Montgomery-Smith, S. Polyomino-0.4, available online http://www.math.missouri.edu/stephen/software/polyomino, 4 pages.
Putter, G. Gerard's Universal Polyomino Solver, available online http://www.xs4all.nl/_gp/PolyominoSolver/Polyomino.html. 7 pages.

* cited by examiner

*Primary Examiner* — Trinh Dinh
(74) *Attorney, Agent, or Firm* — Reinhart Boerner Van Deuren s.c.

(57) ABSTRACT

Methods for producing wide-band planar array antenna designs and antenna corresponding thereto.

17 Claims, 7 Drawing Sheets

38

70

METHOD AND APPARATUS FOR WIDEBAND PLANAR ARRAYS IMPLEMENTED WITH A POLYOMINO SUBARRAY ARCHITECTURE

CROSS-REFERENCE TO RELATED APPLICATION

This application claims priority benefit of provisional application Ser. No. 60/964,145, filed on Aug. 9, 2007, which application is hereby incorporated herein by reference in its entirety.

STATEMENT REGARDING FEDERALLY SPONSORED RESEARCH

The United States government has certain rights to this invention pursuant to a United States Air Force Grant No. FA8718-06-C-0047.

BACKGROUND OF THE INVENTION

Field of the Invention

This invention relates to wideband planar array antennas, and more particularly, to wideband planar arrays implemented using polyomino shaped subarray architecture and to a design methodology therefore.

In order to operate a large, planar array over a finite bandwidth, one must insert time delay behind the individual elements. Because time-delay modules are often bulky and expensive, designers will often group several elements together to form a subarray. A typical subarray architecture places a phase shifter in series with each element of the subarray and a single time-delay control for the entire subarray. The time delay is chosen such that one of the subarray elements will exhibit perfect phase control regardless of frequency. This element is called the "phase center" of the subarray. This illustrates one of the tradeoffs associated with subarray architectures—reducing the number of time-delay units may reduce the size, complexity, and cost of the array, but it also decreases the available degrees of freedom (i.e., perfect time delay at every element vs. perfect time-delay at only the phase-center element), which leads to pattern degradation. But, as described below, a clever choice of subarray architecture can minimize pattern degradation.

As is stated above, time delay is most often introduced into phased array systems by using phase shifters at the array face and time delay units behind rectangular subarrays. This practice leads to significant quantisation lobes that degrade the pattern severely. These quantization lobes are located at the grating lobe locations for the array factor with spacing equal to the subarray dimensions. Alternatives that include interlacing or overlapping the subarrays have been understood for years and have been demonstrated in practice, as shown in references [1, 2] listed herein below. However, they are relatively difficult and costly to build. Thinned-array alternatives can have significant residual 'error sidelobes' even at center frequency. The use of irregular subarrays can suppress these quantisation lobes. Several other recent papers use random or irregular subarrays, or related techniques, to randomise phase-center locations. See for example references [3-6] listed herein below.

REFERENCES

Background information, including references cited in this application, together with other aspects of the prior art, including those teachings useful in light of the present invention, are disclosed more fully and better understood in light of the following references, each of which is incorporated herein in its entirety.

1 Tang, R.: 'Survey of time delayed beam steering techniques' in 'Phased array antennas: Proc. of the 1970 Phased Array Antenna Symposium' (Artech House, Dedham, Mass. 1972), pp. 254-260

2 Mailloux, R. J.: 'Phased array antenna handbook' (Artech House, Dedham, Mass., 2005, 2nd edn.)

3 Mailloux, R. J., Santarelli, S. G., and Roberts, T. M.: 'Irregular shaped subarrays for time delay control of planar arrays'. Proc. of 2004 Antenna Applications Symp., Monticello, Ill., USA 4 Mailloux, R. J., Santarelli, S. G., and Roberts, T. M.: 'Polyomino shaped subarrays for limited field of view and time delay control of planar arrays'. Proc. of 2005 Antenna Applications Symp., Monticello, Ill., USA 5 Hansen, R. C., and Charlton, G. G.: 'Subarray quantization lobe decollimation', *IEEE Trans. Antennas Propag.,* 1999, AP-47, (8), pp. 1237-1239

6 Pierro, V., Galdi, V., Castaldi, G., Pinto, I. M., and Felson, L. B.: 'Radiation properties of planar antenna arrays based on certain categories of aperiodic tilings', *IEEE Trans. Antennas Propag.,* 2005, AP-53, (2), pp. 635-643

7 Golomb, S. W.: 'Polyominos: puzzles, patterns, problems, and packings' (Princeton University Press, Princeton, N.J., 1994, 2nd edn.)

8 Martin, G. E.: 'Polyominos: a guide to puzzles and problems in tiling' (Mathematical Association of America, Washington, D.C., 1991)

9 Montgomery-Smith, S.: 'Polyomino-0.4', available online <URL:http://www.math.missouri.edu/stephen/software/polyomino 10 Putter, G.: 'Gerard's Universal Polyomino Solver', available online <URL:http://www.xs4all.nl/_gp/PolyominoSolver/Polyomino.html.

SUMMARY OF THE INVENTION

The present invention can provide a wideband planar array antenna implemented using a polyomino shaped subarray architecture. The geometry of this architecture can be much more random and less periodic than that of the rectangular subarray case. Irregular polyomino-shaped subarrays of the sort provided by the present invention can provide a practical and effective means for introducing time delay into an array with phase steering. In addition, in certain non-limiting embodiments such polyomino-shaped subarrays can result in the elimination of quantization lobes, with resulting peak sidelobes suppressed more than about 20 dB below the quantization lobes of an array of rectangular subarrays. In the case of L-octomino subarrays, for example and only for purpose of illustration, the phase centers of L-octomino subarrays can be randomly placed and thus are not equally spaced along the x- and y-dimensions. Random placement of phase-center location can lead to quantization-lobe suppression for such subarrays. In addition to the ability to reduce sidelobe interaction, the present invention can have particular application in small phase array radar doing the job of larger array and benefits getting better information.

The invention can also provide a method and/or computer program, as can be used in conjunction therewith, for designing large, planar array apertures which can implement a novel subarray architecture. In particular, irregularly-shaped, polyomino subarrays can be used to reduce sidelobe levels in the far-field radiation pattern. Without limitation, such a program and/or method of this invention can use a tiling code in conjunction with an antenna-array simulator to first produce several designs, all of which can satisfy certain user-specified parameters (i.e., array size, subarray size, etc.). Then, the entire set of designs can be analyzed to determine which array(s) possesses superior performance.

Such a program and/or method can dramatically decrease the time to construct a single array. Moreover, program code associated therewith can be used to test hundreds of designs at multiple frequency points. The novel method(s)/program(s) of this invention can provide an approach to carrying out "what if" scenarios, changing one or more parameters and monitoring the results of the changes, thereby testing the design of many arrays without actually physically constructing the arrays.

Without limitation, in order to construct large arrays without increasing computation time, the new method and/or an associated program code used therewith allows smaller arrays to be grouped together. By way of example, in certain non-limiting embodiments, four 32×32-element arrays of L-shaped octominos can be combined to form a single 64×64-element array. In addition, the novel program can convert an array of identical-shape polyominos of order N into an array of multiple-shape polyominos of order 2×N. For instance, in but one such embodiment, a 32×32-element array of L-shaped octominos (N=8) can be converted into an array of hexadecominos (N=16) with multiple shapes.

DESCRIPTION OF THE DRAWINGS

These and other advantages of the present invention are best understood with reference to the drawings, in which.

DETAILED DESCRIPTION OF THE PREFERRED EMBODIMENT

Figure 1:
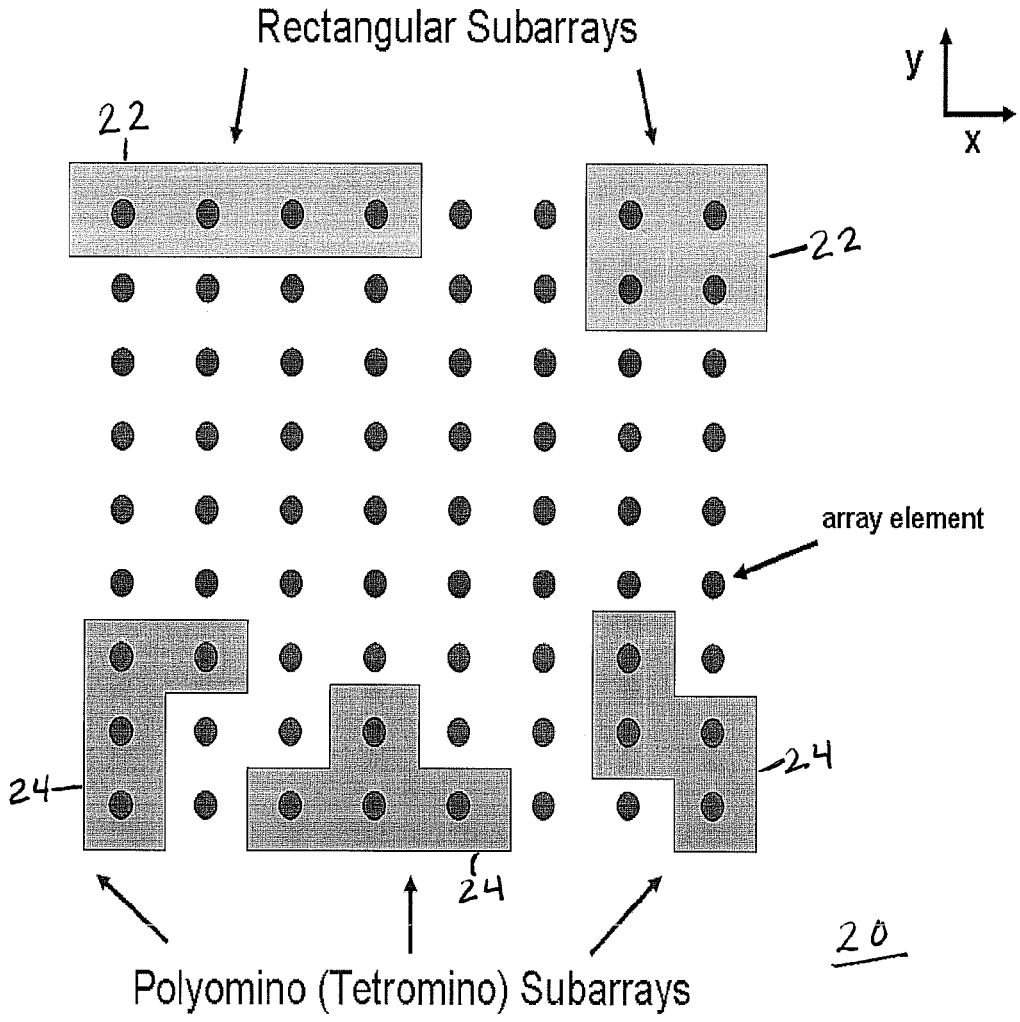
FIG. 1 illustrates conventional rectangular subarrays vs. irregularly-shaped, polyomino subarrays.
Figure 2:
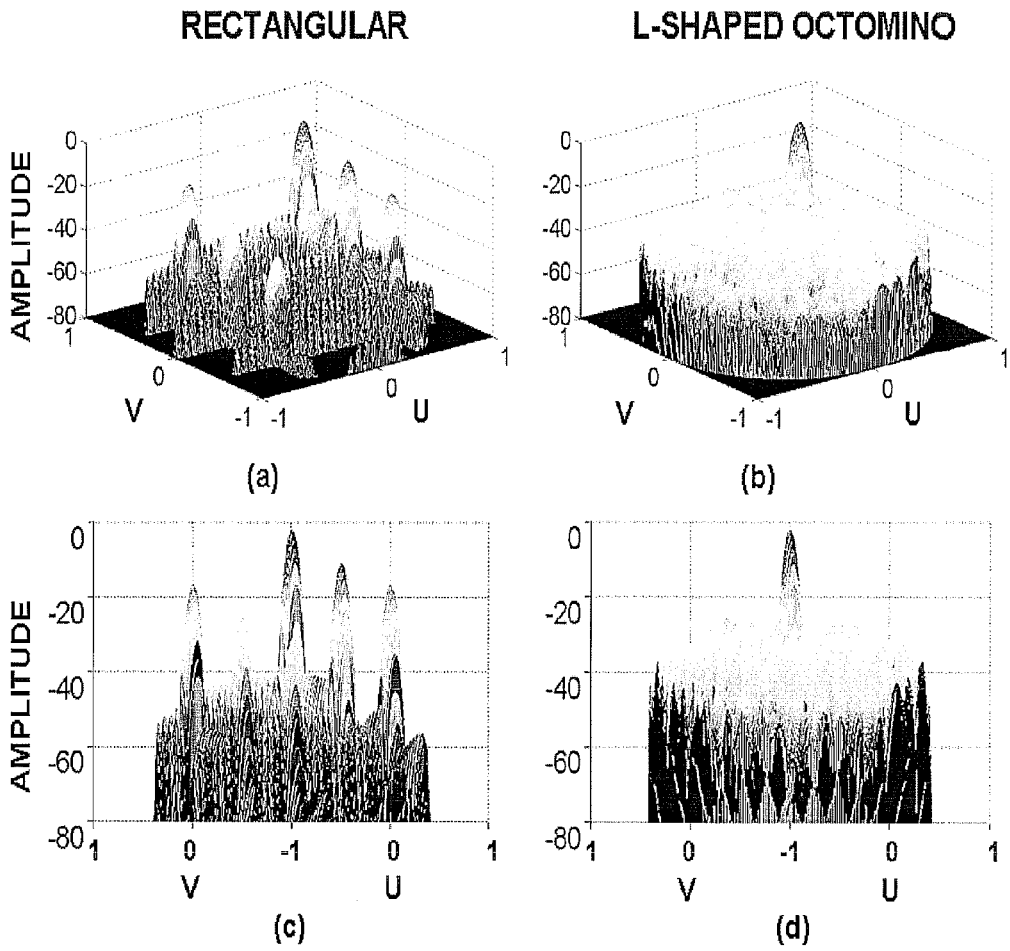
FIGS. 2A-2D illustrate far-field radiation characteristics of arrays employing rectangular subarrays and polyomino subarrays, with FIG. 2A being a pattern of an array of rectangular (2×4) subarrays, FIG. 2B being a pattern of an array of L-octomino subarrays, FIG. 2C being a projected pattern of rectangular subarrays, and FIG. 2D being a projected pattern of L-octomino subarrays.

Referring to the drawings, FIG. 1, which is an overhead view of an array aperture 20, shows two different types of subarray geometries. "Rectangular subarrays" 22 are a common choice of architecture because of their simplicity. The simple "stackable" geometry allows one to easily divide the array into subarrays such that every element belongs to one, and only one, subarray (no "holes") and this geometry requires a relatively simple feed network). This type of architecture, however, is highly periodic, meaning that the phase centers of the individual subarrays are equally spaced along both the x- and y-dimensions. As illustrated in FIGS. 2A and 2C, this periodicity leads to large quantization lobes in the far-field radiation pattern of the array. FIG. 2A shows a three-dimensional view of the pattern corresponding to a 32×32-element array consisting of 128, 2×4 subarrays. The main beam is steered to (u, v)=(0.5, 0.5) at a frequency of $1.3\times f_0$ (where $f_0$ represents center frequency). FIG. 2C is the projected pattern when viewed along the line u=v. Note that the highest quantization lobe is only approximately 10 dB below the main beam.

Also shown in FIG. 1 are examples of irregularly-shaped subarrays 24, in particular, tetrominos. Imagine that each array element lies at the center of a square unit cell. Tetrominos are then defined as having four elements such that adjacent unit cells share a common side (i.e., elements can be adjacent along the x- and y-dimensions but not diagonally). Polyomino is the general term used to describe this type of unit-cell geometry. Just as the familiar domino corresponds to two elements, tetromino corresponds to four, and octomino, eight.

Figure 3:
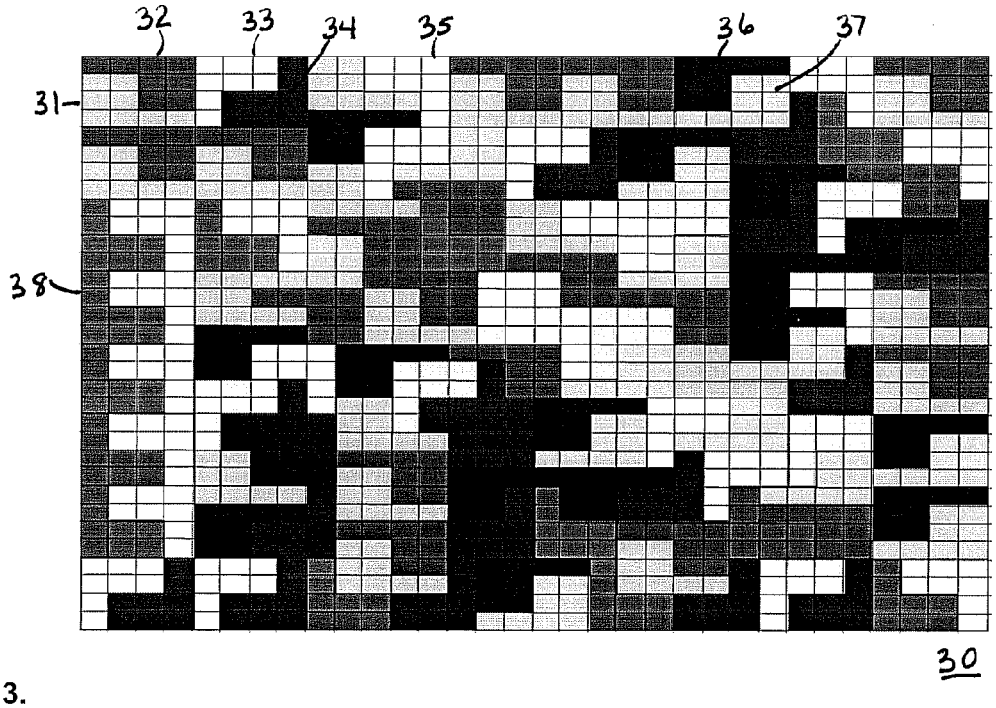
FIG. 3 shows a 32×32-element array consisting of 128 L-shaped octominos.

As opposed to rectangular subarray architectures, it has been found that the use of irregularly-shaped subarrays leads to quantization-lobe suppression. FIG. 3 shows a 32×32-element array 30 consisting of 128 L-shaped octominos. Each of the eight orientations 31-38 of the octominos is represented by a different shade or color. Note that the geometry of this architecture is much more random and less periodic than that of the rectangular subarray case. In particular, the phase centers of the L-octomino subarrays are no longer equally spaced along the x- and y-dimensions. As illustrated in FIGS. 2B and 2D, this random placement of phase-center location leads to quantization-lobe suppression. Again, FIG. 2B shows a three-dimensional view of the pattern when the main beam of the array 30 shown in FIG. 3 is steered to (u, v)=(0.5, 0.5) at a frequency of $1.3\times f_0$. FIG. 2D is the projected pattern when viewed along the line u=v. Note that the sidelobes have been reduced to approximately 25-30 dB below the main beam (as opposed to only 10 dB for the rectangular case).

Polyomino Subarrays.

In accordance with the invention, polyomino subarrays are used to provide time delay for a large array. Polyominos are figures composed of elements on a square grid. Particular L-shaped-tetromino and -octomino subarrays seem practical for reasons mentioned above and in earlier publications, such as references [3, 4] listed above. The words tetromino and octomino extrapolate from the familiar word domino. Dominos have two elements; tetrominos have four; octominos have eight. Systematic study of polyominos, as the general figures are named, began in 1953 and now has a substantial literature in mathematical combinatorics, represented by references [7-10], for example, listed above.

Working by hand and rejecting periodicity, Applicants were unable to exactly fill any large array using just tetrominos or just octominos. Nonperiodic arrangements all had elements protruding beyond the rectangular boundary, as reported in reference [3] listed above. The hand-made arrays had some of the lowest sidelobes, but were extremely tedious to arrange.

Figure 4:
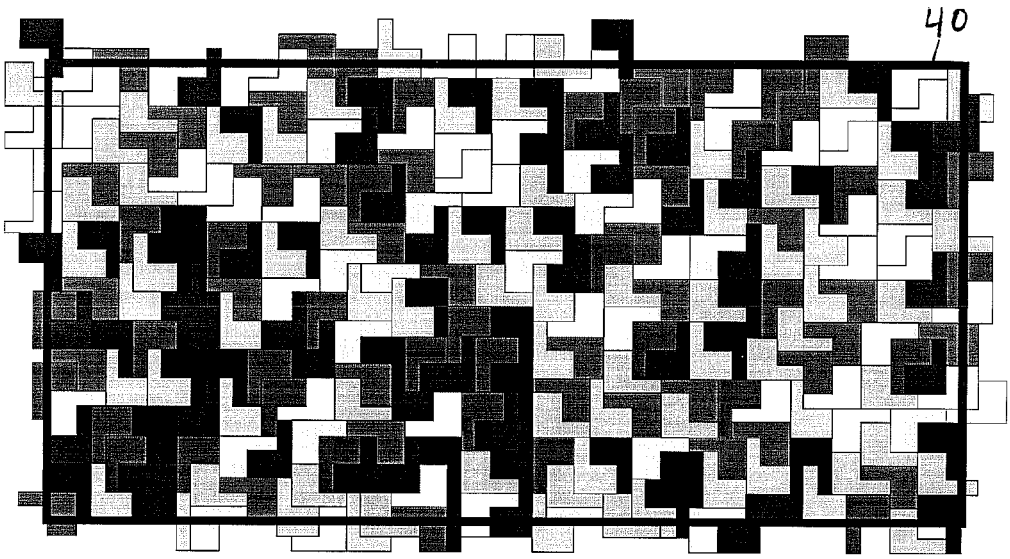
FIG. 4 illustrates an array of 2048 elements in 256 L-octomino subarrays.

Applicants have developed a software code written in MATLAB®, which allows the user to manually construct a polyomino tiling 38, such as that shown in FIG. 4. Furthermore, this code converts the tiling to an antenna array design by assigning appropriate design values to each element in the array (i.e., phase shift, time delay, attenuation, etc.). Limitations of this program include the following. The process is extremely tedious and time-consuming. The user must place each polyomino shape within the rectangular grid manually using the mouse. Sometimes the user inadvertently creates a "trap" (i.e., a tiling containing overlapping polyominos or "holes") and must "un-do" a portion of the tiling to get back on track. Furthermore, it is highly unlikely for the user to create a tiling that is perfectly bounded by the specified rectangular area 40 on array 38 as shown in FIG. 4. Moreover, this program can only simulate a single antenna-array design at a single frequency.

Applicants discovered that the production of tiled arrays can be automated by producing tilings automatically using a publicly-available computer code which automatically generates polyomino tilings. Applicants generated $10^7$ distinct tilings using only flipped and rotated copies of identical subarrays and a tiling program, which was being used as a Linux screensaver. One such computer code is that developed by and available on the world wide web through Stephen Montgomery-Smith, a professor at the University of Missouri at Columbia. The name of the code is polyomino-0.4, and it was originally used as a computer-monitor screen saver. This code is hereinafter referred to as Program A.

For tiled arrays, the overall center-frequency pattern is identical to the centre-frequency pattern of the phase shifted array, without reduction of aperture efficiency. The number of elements in each subarray is $2^n$ (n>0) so a lossless power divider can feed each subarray. The specific results described herein are for L-octominos and the rectangular subarrays they replace. However, other types of polyominos can be used to form the subarrays.

Referring to FIG. 4, which shows an array 38 of 2048 (64×32) elements grouped into 256 L-octomino subarrays. With an array of identical but rotated shapes, one can use the same power divider networks and build the array on a rectangular grid without considering the figures that will later form the subarrays. Subarrays can be formed entirely in the control network that feeds the elements.

Figure 5:
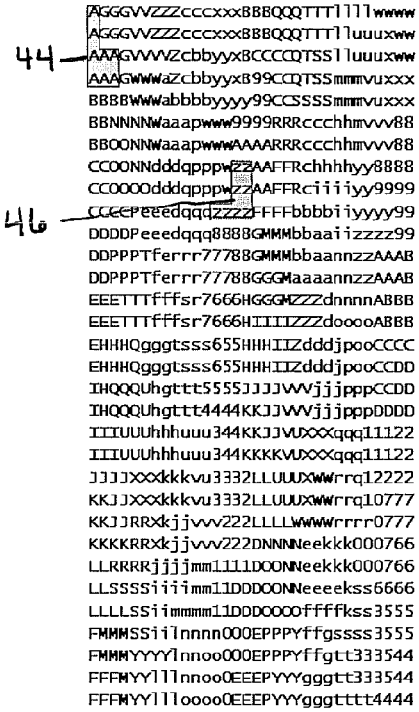
FIG. 5 is an example of raw tiling data in text format produced by Program A.

A tiling represents one deterministic array. A tiling is defined as a rectangular area in which polyomino shapes are inserted such that (1) no two polyominos overlap and (2) no polyomino extends past the rectangular boundary (FIG. 3 is an example of a perfect tiling). In particular, Montgomery-Smith's code is able to generate polyomino tilings of various sizes, such as 32×32, using various shapes, such as L-shaped octominos. The polyomino-0.4 code produces raw tiling data in text format as shown in FIG. 5. Here, there can be seen a 32×32-element tiling of 128 L-shaped octominos, where each octomino is denoted by a specific character. Two of the octominos 44 and 46 are outlined for clarity. Although this code can produce perfect tilings automatically, it is limited in the following ways:

1) The computation time increases exponentially as the specified array size increases for certain polyomino shapes. For example, it has been found that hundreds of 32×32-element tilings of L-shaped octominos can be tiled in mere seconds, whereas it can take several days to generate a single 100×100-element tiling of the same shape.
2) Tiling is limited to a single polyomino number and shape. For example, the program is only capable of producing a homogeneous tiling of L-shaped octominos or T-shaped tetrominos—it is unable to produce a single tiling containing both.
3) This program produces tilings only. In other words, the program produces tilings in a strictly mathematical sense—the raw output must be post-processed in order to convert the tiling data into an antenna array design.

The L-octomino array 38 shown in FIG. 4 was analyzed under the assumption that an amplitude taper was imposed at every element across the array, not just at the subarray ports. Subarray-amplitude-quantisation effects are usually much smaller than phase- or time-delay quantisation effects, especially in a large array, and accordingly, have not been studied here.

The excitation for each subarray is a time-delayed signal that excites all subarray elements, but is timed so that the time delay is exact at a single element chosen as the phase centre. The same element is used as the phase centre for all 90° rotations of the subarray. The phase shifters at the other elements in the subarray are chosen to produce a progressive phase across the subarray, and thereby a continuous phase progression across the whole array at centre frequency.

Reference is again made to FIGS. 2A-2D. FIGS. 2A-2D show pattern data plotted in direction cosine space, $u=\sin\theta\cos\phi$ and $v=\sin\theta\sin\phi$, for two arrays scanned to $(u_0,v_0)=(0.5, 0.5)$. The first array has 256 rectangular subarrays of eight elements spaced 0.5λ apart at the highest frequency, $r=f/f_0=1.2$, and arranged in a 4×2 grid. FIG. 2A shows the periodic quantization lobes. FIG. 2B shows the associated pattern for the array of octomino subarrays. FIGS. 2C and D show the three dimensional patterns projected on to the plane so that sidelobe levels can be measured. The largest of these quantization lobes is approximately −11.5 dB below the broadside gain for the array of rectangular subarrays (FIG. 2C). Representative results illustrated in FIG. 2D for the array of octomino subarrays show lower peak sidelobes with the highest being approximately −25.9 dB relative to broadside gain, or reduced by approximately −14.4 dB relative to the rectangular subarray configuration. The difference in gain between these two patterns was 0.1 dB based on pattern integration.

Results for Octomino Unit-Cell Arrays and Arrays of Unit Cells.

Using the polyomino tiling program described above in conjunction with an antenna-array simulator, several designs, all of which satisfy certain user-specified parameters (i.e., array size, subarray size, etc.) were produced and analyzed. Ninety-nine random tilings were generated using the L-shaped octomino. Each tiling consisted of 128 octominos and covered an area corresponding to a 32×32-element array or 'unit cell.' Ninety-six unit cells are used to construct 24 64×64 arrays. Then, the radiation pattern was calculated for each of the original ninety-nine unit cells in addition to the newly constructed 64×64 arrays.

The average sidelobe levels were computed against frequency for both sets of tilings. The conclusions are as follows. The octomino data for either array size (i.e. 32×32 or 64×64) are clustered within roughly 1 dB or less from the mean of the data set at each discrete frequency. This implies that the average sidelobe level does not change significantly against array tiling. The mean itself is within about 1 dB of the average sidelobes of the array of rectangular subarrays. The average sidelobe level itself is proportional to the phase-error variance and is independent of the array size, so doubling the array size reduces the average level by about 6 dB, as expected.

Figure 6:
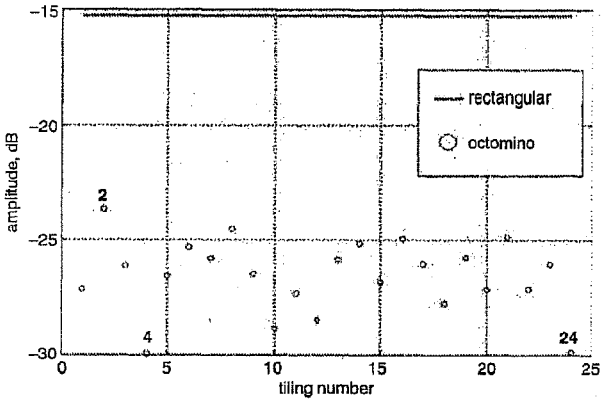
FIG. 6 is a plot of maximum sidelobe level against tiling configuration for rectangular and octomino tiled arrays.

FIG. 6 is a plot of the maximum sidelobe level against tiling configuration for the set of 64×64 octomino arrays for a constant frequency ratio of $r=f/f_0=0.7$. The solid line represents the maximum sidelobe level for the corresponding 64×64 rectangular array. Note that even the worst of the octomino arrays (tiling 2) is roughly 8-9 dB below the rectangular value. Some of the octomino arrays (tilings 4 and 24) are as much as 15 dB below the rectangular value. The range of values is considerable, roughly 6.5 dB; thus, although the average sidelobe level does not depend heavily on tiling configuration, the maximum sidelobe level does. This wide range of values corresponding to the maximum sidelobe level illustrates the importance of array simulation and analysis as part of the design process. For example, the analysis presented in FIG. 4 allows one to choose a 'good' tiling (such as 4 or 24) rather than a 'bad' tiling (such as 2).

The resulting data discussed above was obtained from arrays of L-octomino shaped subarrays used to provide time delay steering for a phase steered array. The results demonstrate elimination of the −11.5 dB quantisation lobes that are radiated by an array of rectangular subarrays, and their replacement by lower sidelobes that are between −25 and −26 dB below the main beam gain at broadside.

In summary, therefore, a subarray architecture consisting of irregularly-shaped, polyomino subarrays offers significant sidelobe suppression when compared to an architecture consisting of rectangular subarrays.

Figure 7:
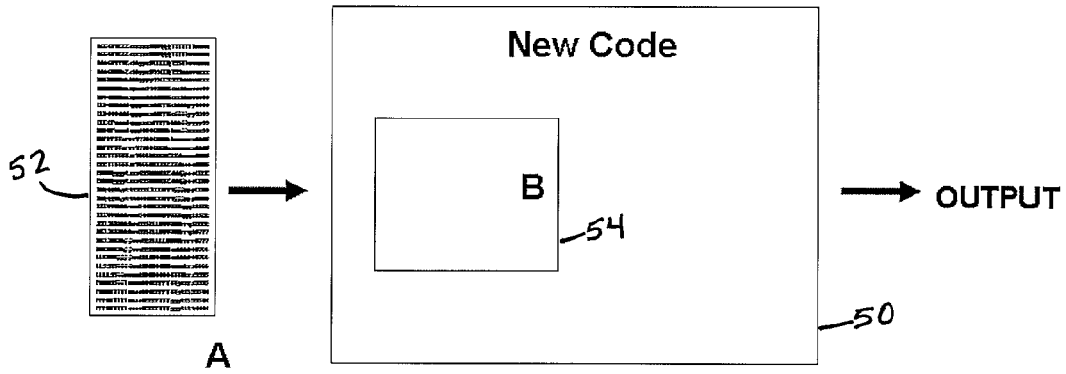
FIG. 7 is a block diagram of a novel design methodology paradigm in accordance with the present invention.
Figure 8:
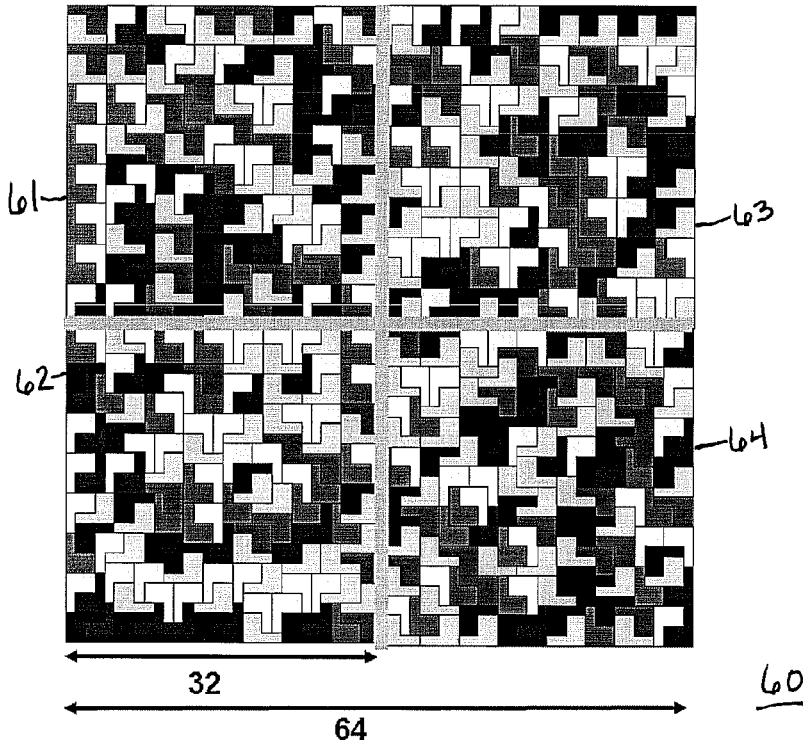
FIG. 8 is an example of how larger tilings can be created by concatenating smaller tilings.

Referring to FIG. 7, the novel design methodology in accordance with the present invention is represented by block 50. Basically, the raw text output (FIG. 5) from Program A, block 52, is the input to block 50 which is referred to as Program N. In addition, the electromagnetic simulation aspects of Program B, block 54, are included in the new code (Program N). In short, the Program N in accordance with the present invention uses Programs A and B to accomplish the following. This novel program code dramatically decreases the time it takes to construct a single array. This novel program code has the ability to test hundreds of designs at multiple frequency points. In order to construct large arrays without increasing computation time, the new program code allows smaller arrays to be grouped together. In the example shown in FIG. 8, four 32×32-element arrays 60 of L-shaped octominos 61-64 are combined to form a single 64×64-element array 60. Note that this overcomes the first limitation of Program A.

Figure 9:
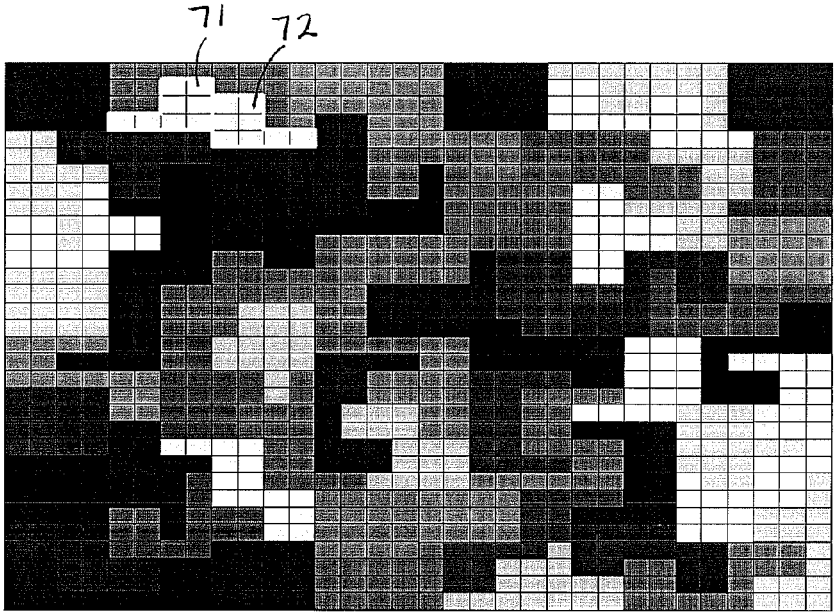
FIG. 9 is an example of how an array of multi-shaped hexadecominos can be made from an array of L-shaped octominos.

The novel program code can convert an array of identical-shape polyominos of order N into an array of multiple-shape polyominos of order 2×N. For example, FIG. 9 shows how a 32×32-element array 70 of L-shaped octominos (N=8) can be converted into an array of hexadecominos (N=16) with multiple shapes. Two octominos 71 and 72 in the upper left corner of the figure are outlined in white to demonstrate this concept. This overcomes the second limitation of Program A.

Thus, the present invention represents an innovation in polyomino tilings, polyomino antennas, and other improvements over Program A. The present item regards uncorrelated or dissimilar tilings. Program A is an open-source subroutine package named polyomino-0.4.tar. It is written in the computer language named C and has been available online from http://www.math.missouri.edu/~stephen/software/polyomino/polyomino-0.4.tar.gz since Jan. 21, 2001. A related subroutine package polyomino-0.4.zip has been available online since Feb. 3, 2001 and from, as indicated above, <URL: http://tinyurl.com/rsy3g. Program A searches for tilings and displays each one found. It continues until the user stops the program. It has been found that such use ordinarily produces a sequence of tilings that are predominately alike and are therefore unlikely to produce useful, innovative tilings. The predominately-alike tilings are called correlated tilings. Because sets of dissimilar tilings are often more useful for designing polyomino-based antennas, Applicants have created a technique to make one tiling at a time in such a way that a large collection of tilings would be uncorrelated (unlike each other). Because the header file polyomino.h of Program A gets a new random-number seed every time it is started, uncorrelated tilings will be the usual result when a person makes one tiling at a time. In a linux or similar computer, such as may be commonly used with the C-language program of Program A, one can use the linux commands called "head" and "tail"—and one's own knowledge of the dimensions of the tiling—to select just the first tiling of a sequence, and then to stop. After one such job has been completed, one may start another, similar tiling job. This similar job will of course have a different random-number seed than was used in the previous job. This explains the mechanism for creating sets of uncorrelated tilings.

A factor-of-8 improvement has been made in availability of computer memory, which is a fundamental improvement to Program A. Program A contains polyomino-0.4.tar as a major constituent. Polyomino-0.4.tar has a crucial header file named polyomino.h. Polyomino.h has many lines of computer code. One of its lines is a declaration of array dimensions. The declaration has the following form: int displ_ws [256][nrpolyominoes][8*polyomino Jen][polyomino_len]. The number 256 above may be replaced with some other numbers, without significant innovation. What is truly innovative, however, is that by merely removing the two characters "8*" from the line involving displ_ws[256], the now-revised polyomino-0.4 package can simulate polyomino antennas that have 8-times as many elements as could be allowed in Program A. This will now be explained. In theory, and as a fact of computer science, there is a maximum amount of physical computer memory available for computations. In context of polyomino tilings and polyomino antennas, the memory limitation restricts the maximum-sized aperture to dimensions that are often described as filling an X-by-Y rectangular grid. In the present context, this would be a grid of elements. By integer arithmetic involving the scaling of memory size and the size of X-by-Y rectangles and apertures, the innovation allows the simulation of polyomino antennas with 8-times as many elements as mentioned above this item. This large improvement is a factor-of-8 enlargement of available memory. Without the innovation, one would be limited to an X-by-Y-rectangle aperture size. With the innovation in accordance with the present invention, one can simulate, design, and tile rectangular apertures of size (4-times-X)-by-(2-times-Y) elements or smaller. Similar innovations also would be useful for rectangular apertures whose major and minor axes differ from the 4:2 ratio mentioned above. The practical usefulness of this innovation was verified by enlarging the useful available memory, and using it, beyond what was possible in Program A.

In addition, a fundamental improvement has been made in developing a technique for creating many large tilings simultaneously. This technique is useful in context of creating uncorrelated tilings, as mentioned above. This is a fundamental improvement to Program A. Modern computers commonly run several jobs at once. But, for many skilled users of computers, it would seem counterintuitive to run on the order of 100 jobs simultaneously on a single computer. Yet, this practice has proven practical. The paradigm is that each tiling job is searching for a polyomino tiling. With 100 jobs, there are 100 chances for a quick tiling, and little incentive for patience. Indeed, most of the runs conducted by Applicants involved 50 to 100 simultaneous jobs. These tilings were produced much more quickly than if they were produced sequentially (one at a time). The usefulness of the technique was verified by using only simultaneous jobs for one day, followed by using only sequential jobs the next day. The simultaneous jobs produced far more large tilings.

Also, a fundamental improvement has been made in creating a technique for culling many large, simultaneous tiling programs, which is useful for creating uncorrelated or dissimilar tilings, as mentioned above. This is a fundamental improvement to Program A. When tilings are made simultaneously, there will be a various number of active tiling jobs. The nature of such work is described above. In this context, it is useful to cull jobs that are judged to be unproductive. There are various strategies for accomplishing this. First, depending on the operating system of the computer at hand, one can monitor how much computer time each tiling job has have consumed. Unproductive jobs, defined as one may choose, can be killed and the computer memory and processors could then be directed toward more-productive work. Second, one can carry out a schedule of culling a specific fraction of the jobs after every interval of a regular number of minutes. The newly available computer resources could then be used for new tiling jobs. The usefulness of this technique was verified by tiling with the culling technique one day, and tiling without culling the next day. The technique using culling produced far more tilings.

Figure 10:
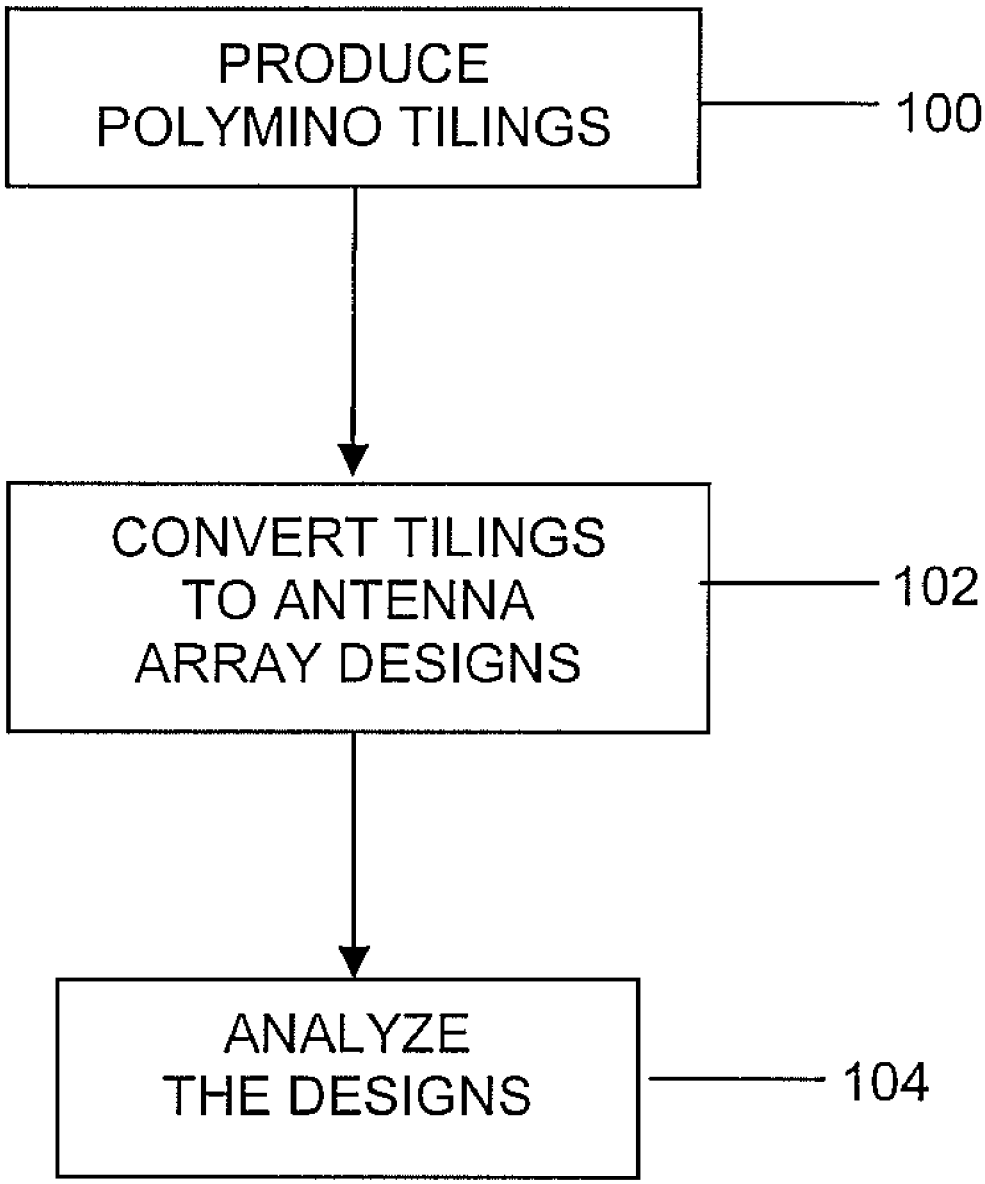
FIG. 10 is a flow chart illustrating a method of producing wide band planar array antenna designs in accordance with the present invention.

Referring to FIG. 10, there is illustrated a flow chart of a method of producing wide band planar array antenna designs in accordance with the present invention. The method includes producing a plurality of polyomino tilings, block 100, including an array of a plurality of irregular shaped polyomino subarrays of elements. The step of converting the polyomino tilings to a set of antenna array designs includes using an antenna array simulator to assign the design values to the elements, and processing tiling data to convert the tiling data into an antenna array design. Preferably, producing polyomino tilings is performed using a tiling computer code to generate the polyomino tilings. The tiling computer code allows the irregular shaped polyomino subarrays of elements to be contained within a rectangular boundary with no two polyominos overlapping and no polyomino extending past the rectangular boundary.

A single polyomino tiling can be produced at a time with and a plurality of polyomino tilings being produced in succession, thereby generating a plurality of uncorrelated polyomino tilings.

In Block 102, the tilings are converted to a set of antenna array designs by assigning design values to each element in the arrays. The design values include at least phase shift, time delay and attenuation.

In Block 104, the entire set of designs is analyzed to allow comparing the performance of the antenna array designs. The entire set of antenna designs is analyzed to allow comparison of the performance of the antenna designs. The entire set of antenna designs is tested by changing one or more parameters and monitoring the results of the changes.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention.

What is claimed is:

1. A method of producing a wide band planar array antenna design, said method comprising the steps of:

producing a polyomino tiling including an array of a plurality of irregular shaped polyomino subarrays of elements, wherein the step of producing a polyomino tiling includes using a tiling computer code stored in a computer readable storage device and executed by a computer to generate tiling data representing a polyomino tiling, wherein the irregular shaped polyomino subarrays of elements are contained within a rectangular boundary with no two polyominos overlapping and no polyomino extending past the rectangular boundary; and converting the polyomino tiling to an antenna array design by assigning design values to each element in the array, wherein the design values include at least phase shift, time delay and attenuation.

2. The method according to claim 1, wherein the step of converting includes using an antenna array simulator to assign the design values to the elements, including processing the tiling data to convert the tiling data into an antenna array design.

3. The method according to claim 1, wherein the step of producing a polyomino tiling includes placing each polyomino shape within a rectangular grid that is bordered by a rectangular area.

4. The method according to claim 1, further including combining 32×32 element arrays of L-shaped polyomino elements to form a single 64×64 element array.

5. The method according to claim 1, wherein the polyomino subarrays include a plurality of L-shaped or T-shaped tetrominos.

6. The method according to claim 1, wherein the polyomino subarrays include a plurality of L-shaped or T-shaped octominos.

7. The method according to claim 6, further including converting a 32×32 element array of L-shaped octorominos into an array of hexadecicominos having multiple shapes.

8. A wideband planar array antenna produced by the method of claim 1.

9. A method of producing wide band planar array antenna designs, said method comprising the steps of:

producing a plurality of polyomino tilings each including an array of a plurality of irregular shaped polyomino subarrays of elements, wherein the step of producing polyomino tilings includes using a tiling computer code stored in a computer readable storage device and executed by a computer to generate the polyomino tilings, wherein the irregular shaped polyomino subarrays of elements are contained within a rectangular boundary with no two polyominos overlapping and no polyomino extending past the rectangular boundary;

converting the tilings to a set of antenna array designs by assigning design values to each element in the arrays, wherein the design values include at least phase shift, time delay and attenuation; and analyzing the entire set of designs to allow comparing the performance of the antenna array designs.

10. The method according to claim 9, including producing a single polyomino tiling at a time and a plurality of polyomino tilings in succession to thereby generate a plurality of uncorrelated polyomino tilings.

11. The method according to claim 9, wherein the step of converting the tilings to a set of antenna array designs includes using an antenna array simulator to assign the design values to the elements, and processing tiling data to convert the tiling data into an antenna array design.

12. The method according to claim 9, wherein the step of analyzing the entire set of designs includes testing the design of the arrays by changing one or more parameters and of one or more subarrays and monitoring the results of the changes.

13. The method according to claim 9, wherein the step of producing polyomino tilings includes placing each polyomino shape within a rectangular grid that is bordered by a rectangular area.

14. The method according to claim 9, further including combining 32×32 element arrays of L-shaped elements to form a single 64×64 element array.

15. The method according to claim 9, further including converting a 32×32 element arrays of L-shaped octorominos into an array of hexadecicominos with multiple shapes.

16. The method according to claim 9, wherein the polyomino subarrays are of order N and are identical in shape, and further including converting the array of identical polyomino subarrays into an array of multiple shaped palomino elements of order 2×N.

17. A method of using a polyomino tiling to produce a wide band planar array antenna design, said method comprising the steps of:

producing a polyomino tiling including an array of a plurality of irregular shaped polyomino subarrays of elements that are contained within a rectangular boundary, wherein the step of producing a polyomino tiling includes using a tiling computer code stored in a computer readable storage device and executed by a computer to generate a polyomino tiling; wherein no two polyominos overlap and no polyomino extends past the rectangular boundary; and converting the polyomino tiling to an antenna array design by assigning design values to each element in the array, wherein the design values include at least phase shift, time delay, and attenuation.

* * * * *